US010180004B1

(12) United States Patent
Simonsen

(10) Patent No.: US 10,180,004 B1
(45) Date of Patent: Jan. 15, 2019

(54) SINGLE EXTRUSION PANEL SYSTEM

(71) Applicant: David J. Simonsen, Redding, CA (US)

(72) Inventor: David J. Simonsen, Redding, CA (US)

( * ) Notice: Subject to any disclaimer, the term of this patent is extended or adjusted under 35 U.S.C. 154(b) by 0 days.

(21) Appl. No.: 15/886,395

(22) Filed: Feb. 1, 2018

(51) Int. Cl.
*E04F 13/08* (2006.01)
*E04B 2/96* (2006.01)
*E04F 19/06* (2006.01)

(52) U.S. Cl.
CPC ..... *E04F 13/0801* (2013.01); *E04B 2/96* (2013.01); *E04F 13/081* (2013.01); *E04F 13/083* (2013.01); *E04F 19/062* (2013.01); *E04F 2201/05* (2013.01)

(58) Field of Classification Search
CPC ... E04F 19/062; E04F 13/0846; E04F 13/081; E04F 13/0814; E04F 13/0816; E04F 13/083; E04F 13/0801; E04F 13/0821; E04F 13/0823; E04B 2/96
See application file for complete search history.

(56) References Cited

U.S. PATENT DOCUMENTS 2,226,679 A * 12/1940 Walters ..... E04F 13/0848 52/416
5,263,292 A * 11/1993 Holland ..... E04B 2/92 52/235
5,893,245 A * 4/1999 Sekiguchi ..... E04F 13/0816 403/295
8,127,507 B1 * 3/2012 Bilge ..... E04F 13/0823 52/235
9,328,517 B2 * 5/2016 Bilge ..... E04F 13/083
9,777,486 B1 * 10/2017 Simonsen ..... E04F 13/0801
2003/0188500 A1 * 10/2003 Voegele ..... E04B 7/04 52/466
2005/0056749 A1 * 3/2005 Simard ..... A47B 57/34 248/248
2006/0179744 A1 * 8/2006 Lynch ..... E04F 13/007 52/235
2009/0272055 A1 * 11/2009 Griffiths ..... E04F 13/081 52/309.3
2012/0096799 A1 * 4/2012 Wright ..... E04F 13/0816 52/578
2014/0059973 A1 * 3/2014 Duranleau ..... E04F 21/1844 52/749.1

* cited by examiner

*Primary Examiner* — Adriana Figueroa
*Assistant Examiner* — Jessie T Fonseca
(74) *Attorney, Agent, or Firm* — Theodore J. Bielen, Jr.

(57) ABSTRACT

A device for mounting a cladding member to a facade utilizing a support. The support includes an appendage that engages an anchor connected to the facade. Sliding engagement of the appendage with the anchor permits the support and connected cladding member to move with the thermal contraction and expansion of the cladding member and support.

18 Claims, 6 Drawing Sheets

SINGLE EXTRUSION PANEL SYSTEM

CROSS REFERENCES TO RELATED APPLICATIONS

The present application claims the benefit of provisional patent application 62/454,152 filed 3 Feb. 2017.

BACKGROUND OF THE INVENTION

The present application relates to a novel and useful device for mounting a cladding member to a facade.

Building facades are often covered with cladding members such as panels that are formed of plate or sheet materials such as ceramic compositions, phenolic resins, insulated plies, and the like.

In installing cladding elements, it is necessary to control water infiltration and drainage behind the cladding members. In addition, the control of thermal contraction and expansion of the installed cladding members must be accommodated.

In the past, many systems have been proposed to install cladding members using multiple extrusions for support and stiffening. For example, U.S. Pat. No. 9,777,486 describes a device for fixing multiple panels to a surface using multiple extrusions.

It is also important to minimize the cost and expense of installing cladding members or panels on a facade while maintaining the integrity and durability of such installation.

A system for installing panels on a facade using a single extrusion panel system device would be a notable advance on the construction arts.

SUMMARY OF THE INVENTION

In accordance with the present application, a novel and useful device for installing a cladding member to a facade is herein provided.

The device of the present application utilizes an anchor fixed to a facade. The anchor includes a flange that extends outwardly from the facade. The anchor may, in certain cases, take the form of a U-shaped member.

A support is also included in the present application and is commonly referred to as an extrusion. The support includes a first surface for holding the cladding member either vertically or horizontally depending on the orientation of the underlying facade. The support also is provided with an appendage that extends outwardly from the first surface. The appendage and the flange of the anchor selectively include an aperture and at least one elongated slot.

A first fastener fixes a portion of the flange to the appendage of the support. Such fastening takes place via the aperture. A second fastener is used to confine the flange relative to the appendage to the slot and permits relative thermal contraction and expansion movement between the flange and the appendage.

A reveal strip is also employed in the present device. The support provides a second surface for positioning the reveal strip between the cladding member mounted on the first surface of the support and the anchor fixed to the facade. The first fastener and second fastener may comprise clevis pins or other known fasteners that maintain the side-by-side positioning of the flange of the anchor relative to the appendage extending from the support.

The support is also dimensioned such that a duplicate of the support serves as a stiffener located beneath the cladding member held by the support. Also, the duplicate of the support may serve as a stiffener located between the cladding member and a portion of the support. Thus, a single extrusion may be employed for the support and the stiffener. Such single extrusion may be formed of metallic material such as aluminum, steel, and the like.

The support may further entail a third surface also capable of holding a reveal strip between the cladding member and the anchor. The second and third surfaces may be alternately used depending on the orientation of the support member relative to the cladding member in the anchor. In many cases, the second and third surfaces are spaced from one another and are oriented in different directions from one another. The first surface may be formed as a portion of a protrusion and include a pocket for holding the reveal strip. The protrusion may further encompass the formation of a wall formed to receive penetration of a third fastener. The third fastener may be employed to form a reveal fastener between the cladding member and the support.

In certain applications, the cladding member may be constructed with a return portion and the device of the present application further includes a depth element located between a portion of the cladding member and said support such that the depth element lies adjacent the return portion of the cladding member.

It may be apparent that a novel and useful device for mounting a cladding member to a facade has been hereinabove described.

It is therefore an object of the present application to provide a device for mounting a cladding member to a facade utilizing a single extrusion system to support and stiffen the cladding member relative to the facade.

Another object of the present application is to provide a device for mounting a cladding member to a facade which is capable of accommodating cladding members formed in a flush or cassette style.

Another object of the present application is to provide a device for mounting a cladding member to a facade that controls water infiltration and drainage and that requires minimum labor and materials for fabrication and installation of such cladding member.

Another object of the present application is to provide a device for mounting a cladding member to a facade using panels fabricated as flush, cassette, or in a 3-D style which may be installed as a dry rain screen system using progressive or non-progressive, sealed, gasketed, or exposed fastener methods.

Another object of the present application is to provide a device for mounting a cladding member to a facade that utilizes a single extrusion that may be used either as a perimeter extrusion, or as a stiffener extrusion.

Another object of the present application is to provide a device for mounting a cladding member to a facade that includes multiple means to support reveal strips where the cladding member is in a vertical or horizontal location.

Another object of the present application is to provide a device for mounting a cladding member to a facade that is capable of using cladding members formed of various materials.

Another object of the present application is to provide a device for mounting a cladding member to a facade that employs a hook-and-pin mounting system in combination with a system for controlling the thermal contraction and expansion of the cladding members.

Another object of the present application is to provide a device for mounting a cladding member to a facade that includes a system for allowing mechanical or adhesive attachment of the panel to a panel support.

Another object of the present application is to provide a device for mounting a cladding member to a facade that allows for multiple panel mounting extrusion placements by the use of a single extrusion.

Another object of the present application is to provide a device for mounting a cladding member to a facade that includes provision in the extrusion support to control the depth of the cladding member relative to the facade.

Another object of the present application is to provide a device for mounting a cladding member to a facade that has of reveal strips to control moisture behind the cladding member and allows for reveal holding cavities that provide for minimum friction between such cavity and the reveal strips, permitting free movement during thermal activity.

Another object of the present application is to provide a device for mounting a cladding member to a facade that possesses the ability to connect perimeter extrusions supporting multiple cladding members resulting in a unitized panel system.

Another object of the present application is to provide a device for mounting a cladding member to a facade employing a single extrusion serving as a panel support and as a stiffener that is capable of being taped, structurally caulked, or mechanically fastened to the panel material.

Another object of the present application is to provide a device for mounting a cladding member to a facade that may be used with adhesive fastening or by exposed fasteners.

Another object of the present application is to provide a device for mounting a cladding member to a facade that permits insulation to be added between the cladding member and the facade anchor, and includes spaces adjacent a reveal strip.

A further object of the present application is to provide a device for mounting a cladding member to a facade that uses an interchangeable support and stiffener device that is economically fabricated and installed in robust construction projects and without any loss of aesthetics.

Another object of the present application is to provide a device for mounting a cladding member to a facade that utilizes a single extrusion system that prevents cladding member supports from being detached from the facade, and has interconnections between supports of multiple cladding members to create a unitized frame for the panel materials.

Another object of the present application is to provide a device for mounting a cladding member to a facade that eliminates the need for the installation of long extrusions on a building facade.

A further object of the present application is to provide a device for mounting a cladding member to a facade that provides for the installation of reveal strips preventing water and air entering the space behind the mounted panel and, thus, complies with testing standards.

Another object of the present application is to provide a device for mounting a cladding member to a facade that includes the installation of short sections of extrusions instead of full panel length pieces and permits panel overlap in such installation.

A further object of the present application is to provide a device for mounting a cladding member to a facade which is applicable to panels having a flat or cassette style structure.

Another object of the present application is to provide a device for mounting a cassette style cladding member where a pair of the returns of such cladding member are fixed to a support via mechanical fasteners.

The invention possesses other objects and advantages especially as concerns particular characteristics and features thereof which will become apparent as the specification continues.

Figure 1:
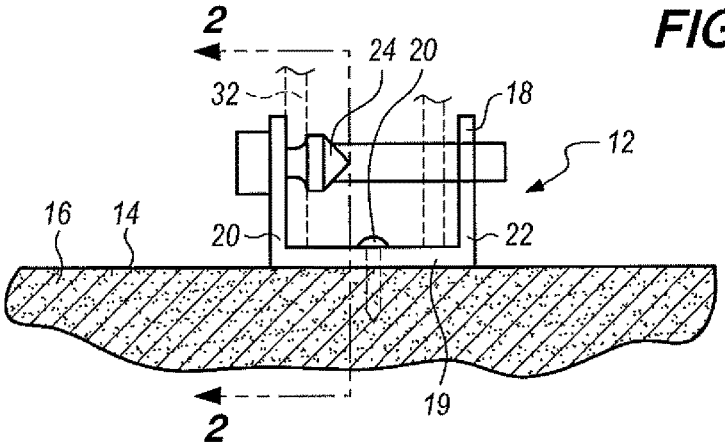
FIG. 1 is a top-elevational view of an anchor employed with the device of the present application mounted to a facade, shown partially in section.

For a better understanding of the application, reference is made to the following detailed description of the preferred embodiments thereof which should be references to the prior described drawings.

DETAILED DESCRIPTION ON THE PREFERRED EMBODIMENTS

Various aspects of the present application will evolve from the following detailed description of the preferred embodiments thereof, which should be references to the prior described drawings.

The application as a whole is depicted by reference character 10 followed by an upper case letter to denote various embodiments of the same.

Figure 2:
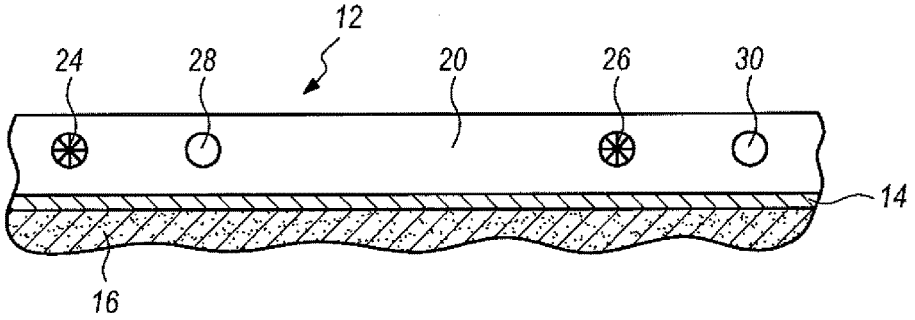
FIG. 2 is a sectional view taken along line 2-2 of FIG. 1.
Figure 3:
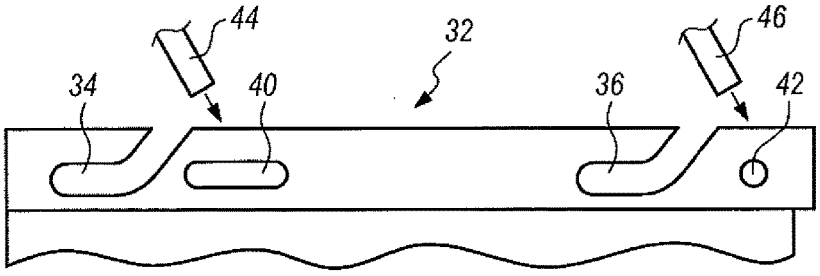
FIG. 3 is a side-elevational view of panel support appendage used with multiple embodiments of the device of the present application.

Turning now to FIG. 1, it may be observed that an anchor 12 is shown which is employed to support various cladding members above a facade 14 of an edifice 16. Anchor 12 includes a U-shaped bracket 18 that includes base 19 and flanges 20 and 22 which extend outwardly from facade 14. Flange 20, depicted in FIG. 2, illustrates the provision of cone-shaped pins 24 and 26 as well as apertures 28 and 30. FIG. 3 represents an appendage that is employed with embodiments of the device of the present application, to be described in detail hereinafter. Specifically, appendage 32 refers to that of embodiment 10E, FIGS. 10-12, although similar appendages will be found in embodiments of the application as the specification continues. Appendage 32 is formed with conventional hook slots 34 and 36 that engage pins 24 and 26 of flanges, respectively. Keeper slot 40 and keeper aperture 42 form part of the present application and are intended to engage keeper pins 44 and 46. Keeper pin 44 extends through keeper slot 40 and aperture 28, while keeper pin 46 is intended to extend through keeper aperture 42 and aperture 30 of anchor 18. It should be realized that the arrangement of pins and slots shown in FIGS. 2 and 3 may be reversed such that keeper slot 40 and keeper aperture 42 may appear on anchor flange 20 and apertures 28 and 30 of flange 20 may appear on appendage 32. Thus, appendage 32 is fastened at keeper aperture 42 and aperture 30 via pin 46. The thermal contraction and expansion movement of appendage 32 is permitted via pin 44, slot 40, and aperture 28. Of course, pins 24 and 26 are free to move along conventional placement slots 34 and 36. Pins 44 and 46, which may take the form of cleavage pins, go through slot 40 and aperture 28 as well as apertures 42 and 30, respectively, and are held there to prevent appendage 32 from moving laterally away from flange 20 of anchor 18. Thus, thermal contraction and expansion is confined to pin 46, aperture 42, and aperture 30. Reveal strips linked to appendage 32, to be described hereinafter, will remain consistently aligned at all times during thermal contraction and expansion of any of the panels found in embodiments to be described hereinafter.

Figure 4:
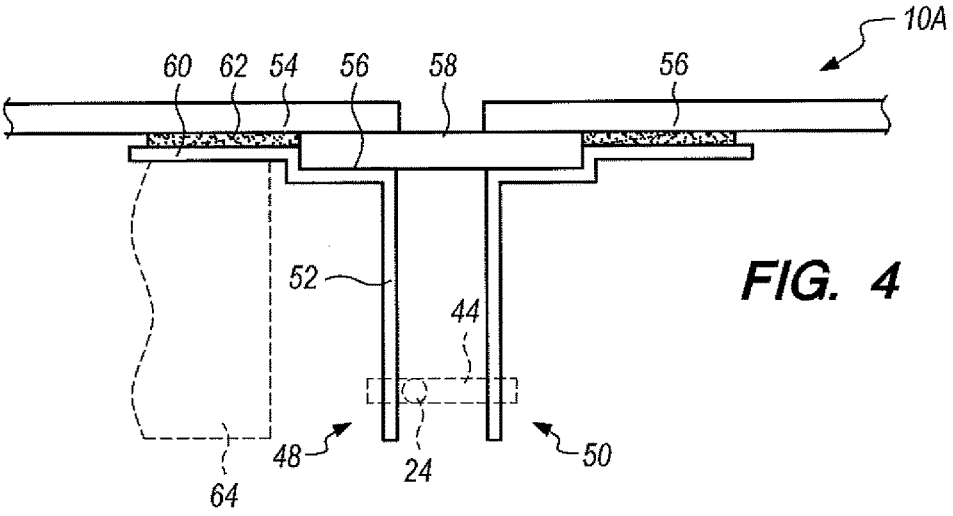
FIG. 4 is a top-plan view of a first embodiment of the support or extrusion.
Figure 5:
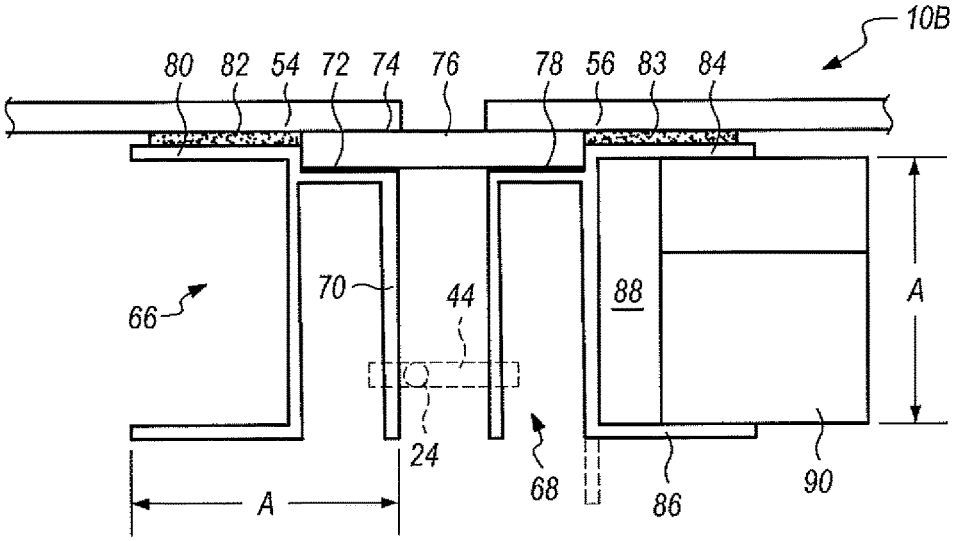
FIG. 5 is a top-plan view of another embodiment of a support or extrusion used with a pair of panels.
Figure 6:
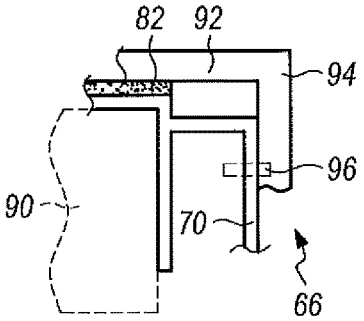
FIG. 6 is a partial top-plan view of the support or extrusion of FIG. 5 used with a cassette-type panel structure.

With reference now to FIGS. 4-6, embodiment 10A of the application is shown. Panel support extrusions or frame members 48 and 50 are duplicates. Exemplar extrusion 48 is formed with leg 52 that serve as a leg similar to appendage 32 of FIG. 3. Leg 52 also provides a sizing gauge to determine the position of cladding member or panel 54 which is being supported with cladding member 56 by support or extrusions 48 and 50. Surface 56 of extrusion 48 serves as a mount for reveal strip 58. Arm 60 of extrusion 48 holds adhesive 62 to the underside of flat cladding member 54. Flat cladding member 56 is held to the same manner by extrusion 50. A stiffener 64 of select configuration underlies extrusion 48.

Turning now to embodiment 10B FIG. 5, flat panels 54 and 56 are being supported by extrusions 66 and 68. Exemplar extrusion 66 includes an appendage 70 which serves the same function as appendage 32 of FIG. 3. Surface 72 forms a recess 74 with the underside of flat cladding member or panel 54. Reveal strip 76 lies within recess 74 and a similar recess 78 with respect to extrusion 68. Reveal strip 76 is not locked in place, but instead moves relative to extrusions 66 and 68 when thermal expansion of panels 54 and 56 takes place. Surface 80 holds adhesive 82 to the underside of flat cladding member or panel 54. A similar adhesive 82 is found on extrusion 68. Adhesive bodies 82 and 83 may take the form of any caulking or tape known in the art. Turning now to extrusion 68, it may be observed that leg 84 forms a space 88 therebetween having a dimension A. Extrusions 66 and 68 also include an equal dimension $A^1$, depicted with respect to extrusion 66 on FIG. 5. Thus, turning extrusion 66 counterclockwise 90 degrees allows the same to assume the orientation of duplicate extrusion 90 which is able to fit within space 88 between legs 84 and 86. The same would be true of extrusion 68 turned clockwise. Needless to say, dimension $A^1$ essentially coincides with dimension A when duplicate extrusion 90 is placed within space 88. Consequently, support extrusion 66 or 68 may also serve as a stiffener in duplicate form. FIG. 6 represents the use of extrusion 66 with a cassette-type panel 92 having a return 94. In such a case, a fastener 96 may be used between return 94 and appendage 70 of extrusion 66, with duplicate extrusion 90 being used as a stiffener, illustrated in FIG. 5.

Figure 7:
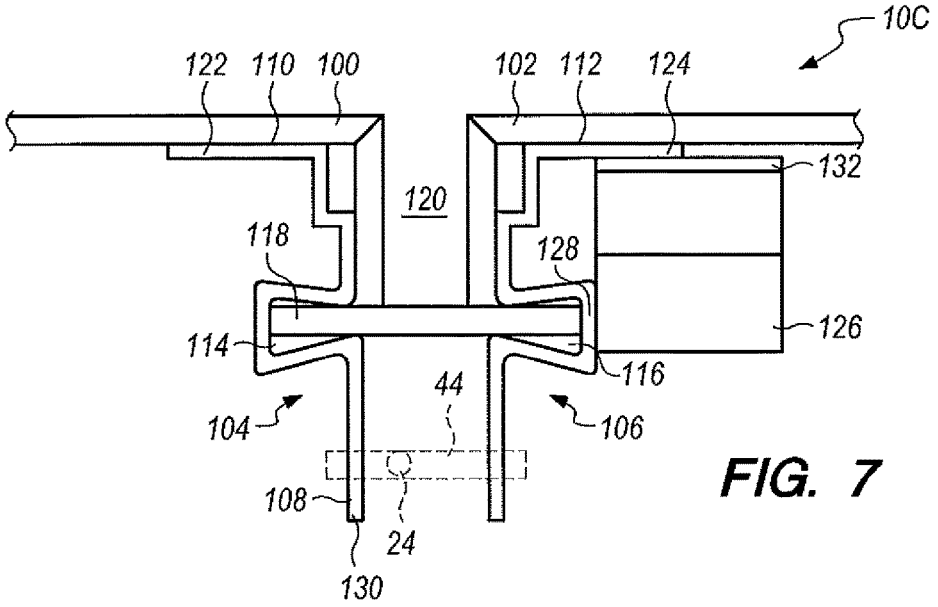
FIG. 7 is a top-plan view of another embodiment of the device of the present application with a duplicate support structure serving as a stiffener.
Figure 8:
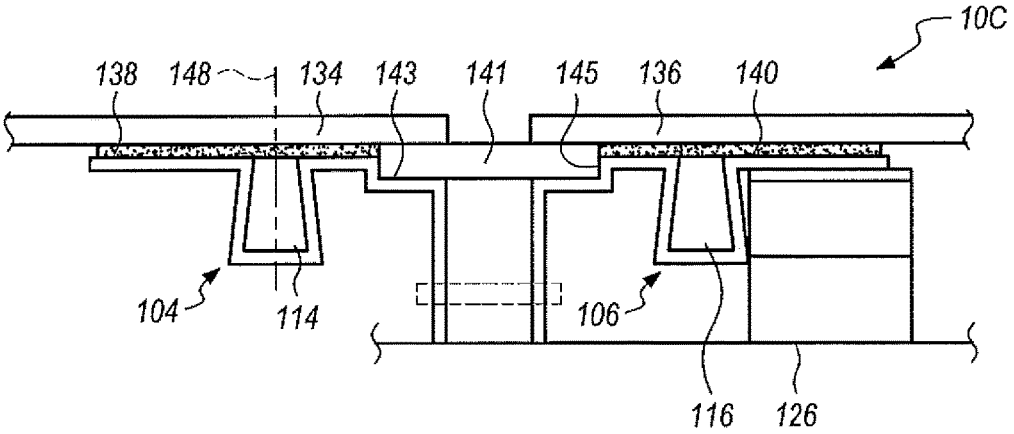
FIG. 8 is a top-plan view of the embodiment depicted in FIG. 7 rotated in a different orientation than that shown in FIG. 7.
Figure 9:
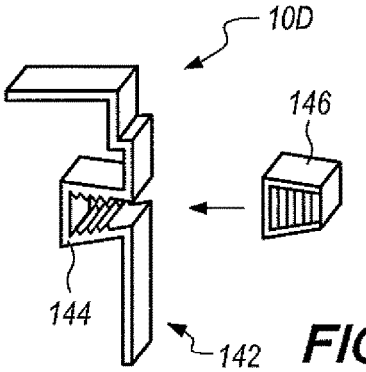
FIG. 9 is a top-right perspective view of one of the supports or extrusions shown in FIGS. 7 and 8, with an alternative pocket structure.

Turning now to FIGS. 7-9, another embodiment 10C of the present application is shown. Cassette panels 100 and 102 are being supported by extrusion frame members 104 and 106. Appendage 108 of support 104 functions as appendage 32 of FIG. 3. Surfaces 110 and 112 of frame members 104 and 106, respectively, support panels 100 and 102. Slots 114 and 116 hold reveal strip 118 below gap 120 between panels 100 and 102. Adhesive layers 122 and 124 may be found between surfaces 110 and panel 100 and between surface 112 and panel 102, respectively. Most importantly, frame members 104 and 106 may serve as stiffeners when duplicates of the same are rotated 90 degrees. For example, the counterclockwise rotation of frame member 104 serves as a pattern for duplicate frame member 126 found beneath panel 102. Adhesive layer 128 holds stiffener 126 in place. Edge 130 of frame member 104 may be used as a visual reference to complimentary edge 132 of duplicate stiffener 126.

Viewing FIG. 8, it may be observed that flat panels 134 and 136 are being supported by extrusion frame members 104 and 106 after 90 degree rotation from that shown in FIG. 7. Adhesive layers 138 and 140 lie between flat panels 134 and frame member 104 and flat panel 136 and frame member 106, respectively. Again, duplicate frame member 126 serves as a stiffener beneath panel 136 due to the appropriate sizing of frame members 104 and 106, similar to that described with respect to frame members 66 and 68 of FIG. 5. Needless to say, a single extrusion of frame member 104, in triplicate, will serve as supports for panels 134 and 136 as well as a stiffener 126 beneath the same. Reveal strip 141 is held in recesses 143 and 145 of frame members 104 and 106, respectively.

Referencing FIG. 9, it may be seen that an alternate embodiment 142 of frame members 104 and 106 is illustrated. Frame member 142 includes a knurled interior recess 144 which is employed to hold a reveal strip more firmly than that shown in slot 114 with respect to reveal strip 118 of FIG. 7. An elastomeric insert 146 may be employed to further resist water infiltration.

When used with a flat panel support structure, frame member 142 knurled slot 144 may serve as a receiver for a fastener (not shown). Returning to FIG. 8, it may be apparent that a fastener 148 may also be employed with slot 114 and slot 116 of frame member 104 and 106. In such a case, embodiment 10A may be considered to be on exposed fastener type.

Figure 10:
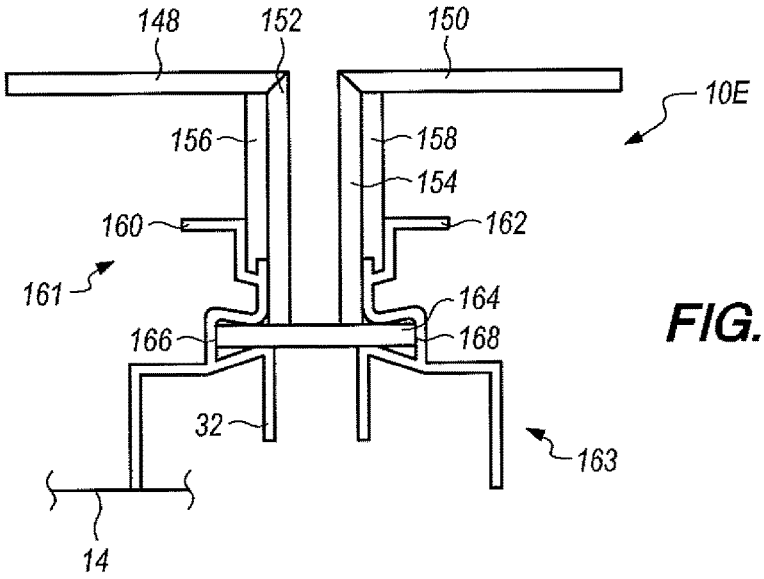
FIG. 10 is a top-plan view of another embodiment of the device of the present invention being utilized with a pair of deep style cassette panels.
Figure 11:
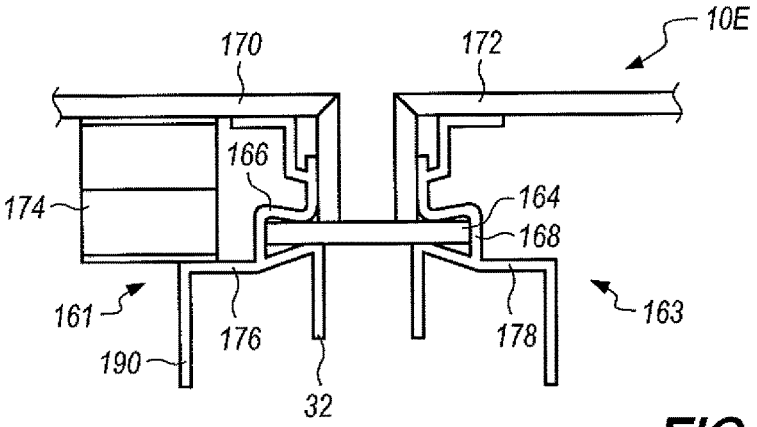
FIG. 11 is a top-plan view of the device of the present application depicted in FIG. 10 being used with a pair of shallow cassette-type panels.
Figure 12:
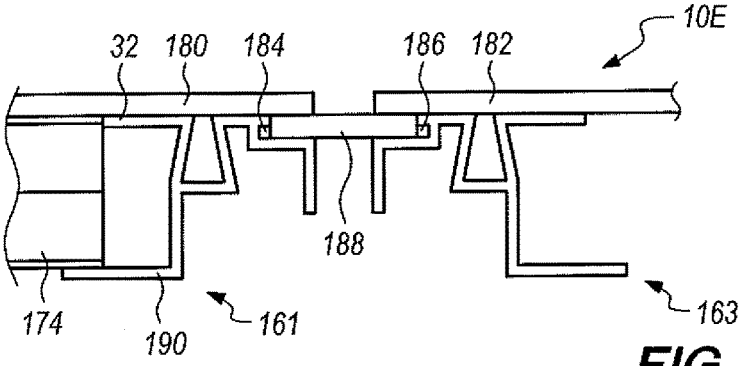
FIG. 12 is a top-plan view of the embodiment of the device depicted in FIG. 10 being employed with a pair of flat panels.

Viewing now FIGS. 10-12, it may be seen that another embodiment 10E of the present application is revealed. FIG. 10 depicts cassette panels 148 and 150 having returns 152 and 154. Fillers 156 and 158 lie against returns 152 and 154.

Arms 160 and 162 of frame members 161 and 163, respectively, serve as a measuring device for the placement of panels 148 and 150 above facade 14. Reveal strip 164 lies within recesses 166 and 168. Adhesive may be placed on the surfaces of frame members 161 and 163 as needed.

FIG. 11 shows shallow depth cassettes panels 170 and 172 being used with frame members 161 and 163. A rotated duplicate of frame members 161 or 163 is being used as a stiffener 174 between panel 170 and legs 176 and 178 of frame members 161 and 163, respectively.

FIG. 12 shows that duplicates of rotated frame members 161 and 163 may be employed to support flat panels 180 and 182. Recesses 184 and 186 hold reveal strip 188. Stiffener 174 sits atop leg 190 beneath panel 180.

Figure 13:
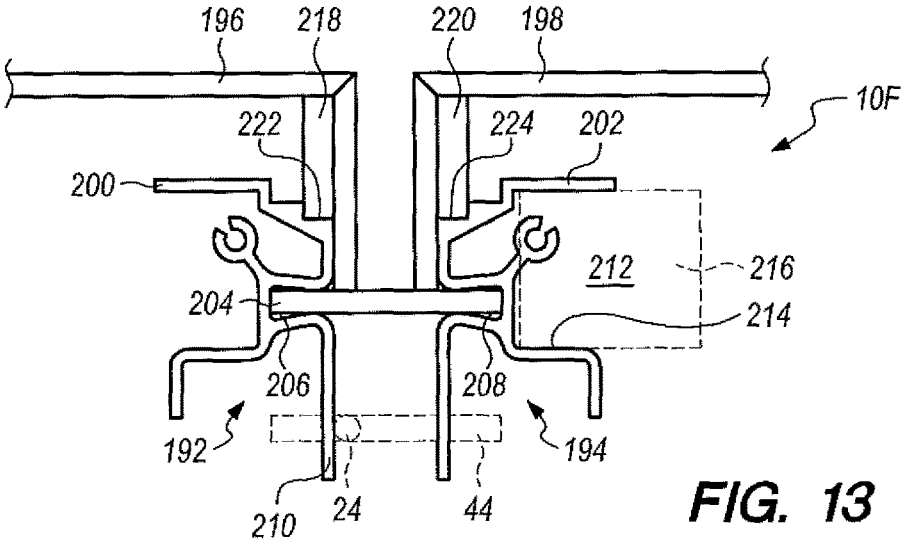
FIG. 13 is a top-plan view of the device of the present application being employed with deep cassette type panels.
Figure 14:
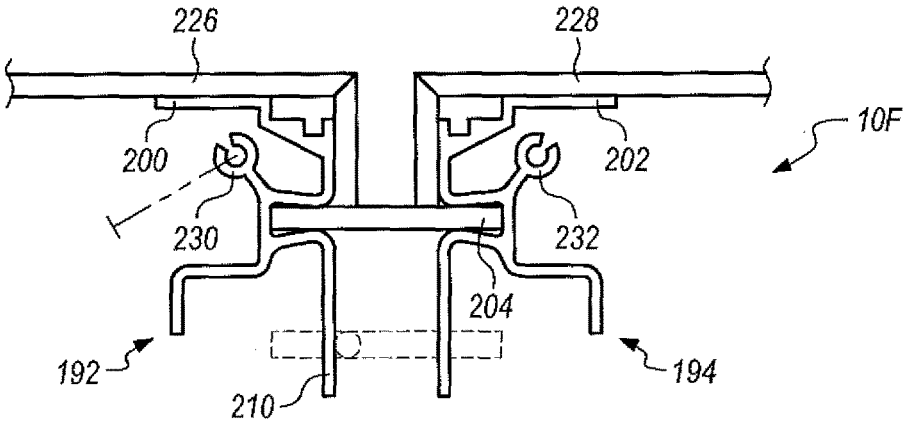
FIG. 14 is a top-plan view of the device of the present application depicted in FIG. 13 being used with shallow cassette type panels.
Figure 15:
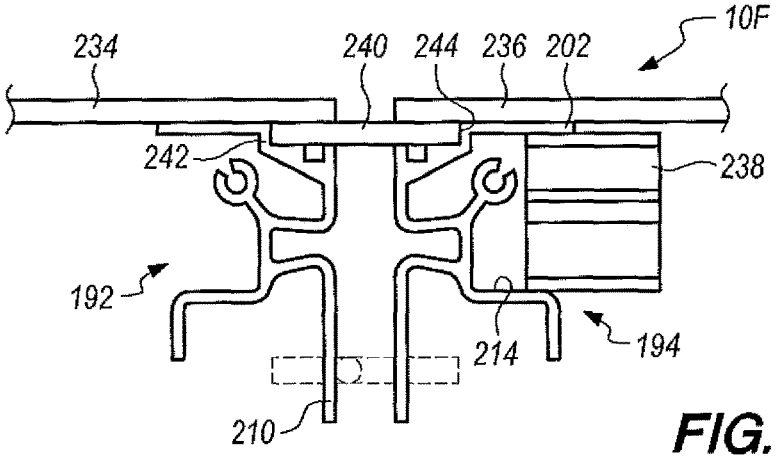
FIG. 15 is a top-plan view of the embodiment depicted in FIG. 13 being employed with flat panels.

Looking now at FIGS. 13-15, yet another embodiment 10F of the present application is shown. FIG. 13 illustrates the use of frame members 192 and 194 to support cassette panels 196 and 198. Surfaces 200 and 202 may be used as a measuring gauge for the positioning of panels 196 and 198. Reveal strip 204 fits within recesses 206 and 208. Leg 210 functions as appendage 32 of FIG. 3. Space 212 between surface 202 and surface 214 is intended to hold a stiffener 216, which is a replica of either frame member 192 or 194, rotated accordingly. Fillers 218 and 220 fit on surfaces 222 and 224. FIG. 14 illustrates a structure for supporting shallow cassette panels 226 and 228 in a similar manner to that shown in FIG. 13. Surfaces 200 and 202 lie against the underside of panels 226 and 228 with adhesive layers therebetween. Circular terminii 230 and 232 may be employed to attach, via screws, frame members 192 and 194 to panels that are perpendicular to panels 226 and 228.

Turning to FIG. 15, it may be seen that flat panels 234 and 236 may be supported by frame members 192 and 194. A duplicate or replica of either frame member 192 or 194 may be used as a stiffener 238 in the space formed between leg 214 and leg 202. Of course, frame members 192 and 194 are dimensioned to permit such use through a single extrusion process. Replica 238 is rotated 90 degrees from the illustration of frame members 192 and 194, in this regard. Reveal strip 240 is supported by recesses 242 and 244.

Figure 16:
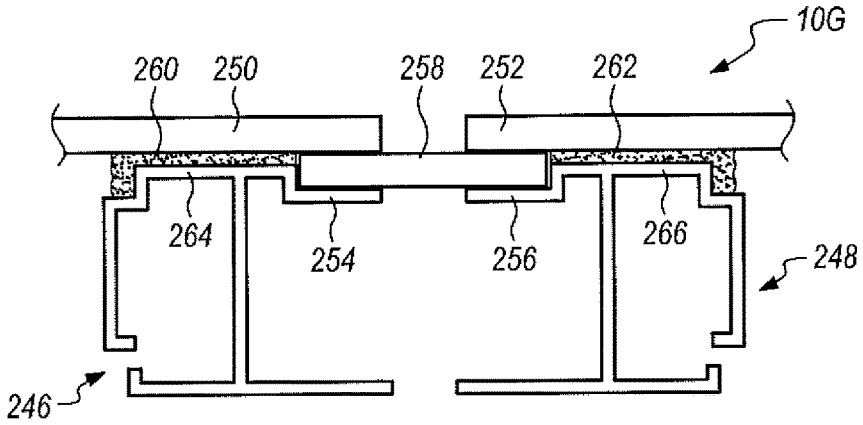
FIG. 16 is a top-plan view of another embodiment of the device of the present application being employed with flat panels.
Figure 17:
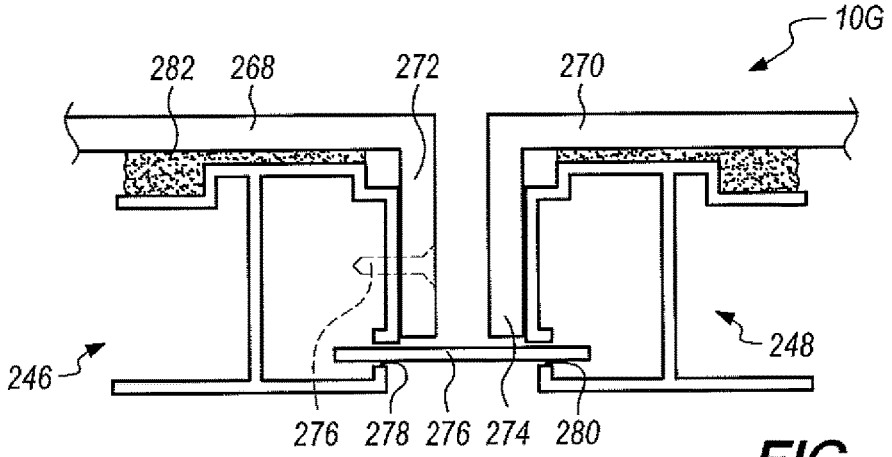
FIG. 17 is a top-plan view of the device of FIG. 16 being used with a pair of cassette type panels.
Figure 18:
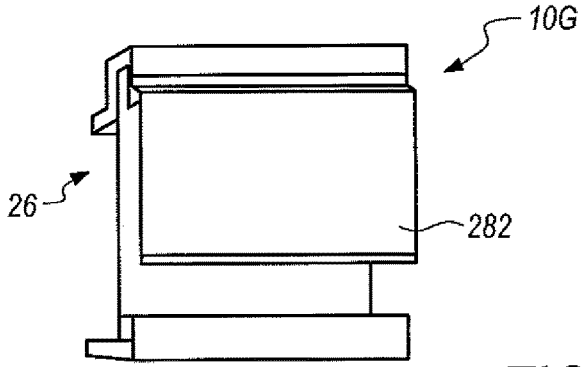
FIG. 18 is a left-side bottom perspective view of the extrusion or support shown in FIGS. 16 and 17.

Observing now FIGS. 16-18, yet another embodiment 10G of the present application is shown. Identical frame members 246 and 248 lie beneath and support flat panels 250 and 252. Arms 254 and 256 support reveal strip 258. Adhesive layers 260 and 262 separate surfaces 264 and 266 from panels 250 and 252, respectively.

Turning to FIG. 17, simple rotation of the frame members 246 and 248 allows frame members 246 and 248 to accommodate cassette panels 268 and 270 having returns 272 and 274, respectively. A screw fastener 276 is used to fasten a portion of frame member 246 to return 272. Reveal strip 276 lies within passageways 278 and 280 of frame members 246 and 248, respectively. FIG. 18 represents a three-dimensional rendition of either frame member 246 or 248 with surface 282 facing outwardly therefrom.

While in the foregoing embodiments of the application have been set forth in considerable detail for the purposes of making a complete disclosure of the invention, it may be apparent to those of skill in the art that numerous changes may be made in such details without departing from the spirit or principles of the invention.

What is claimed is:

1. A device for mounting a cladding member to a facade, comprising:

an anchor, said anchor comprising a flange and a holder for supporting said flange to the facade and extending outwardly from the facade;

a support, said support comprising a first surface for holding the cladding member, said support further comprising an appendage extending outwardly from said first surface, said appendage and said flange selectively including an aperture and an elongated slot;

a first fastener for fixing a portion of said flange to said appendage via said aperture;

a second fastener for confining said flange and said appendage to said slot and permitting relative thermal contraction and expansion movement between said flange and said appendage; and a reveal strip;

a second surface of said support for mounting said reveal strip between the cladding member and said anchor.

2. The device of claim 1 which said first fastener comprises a clevis pin.

3. The device of claim 2 in which said second fastener comprises a clevis pin.

4. The device of claim 1 in which said support is dimensional and that a duplicate of said support serves as a stiffener located beneath said cladding member.

5. The device of claim 1 in which said support is dimensional such that a duplicate of said support serves as a stiffener located between said cladding member and a portion of said support.

6. The device of claim 1 in which said device further comprises third surface capable of holding a reveal strip between the cladding member and said anchor.

7. The device of claim 6 in which said second and third surfaces are spaced from one another on said support and are oriented in different directions from one another.

8. The device of claim 1 in which said first surface is formed as a portion of a protrusion and includes a pocket for holding said reveal strip.

9. The device of claim 8 in which said protrusion is constructed to position adjacent said cladding member and includes a third fastener, said protrusion further comprising a wall formed to receive the penetration of said third fastener.

10. The device of claim 1 which additionally comprises said cladding member including a return portion and further comprises a depth element located between a portion of said cladding member and said support, said depth element lying adjacent said return portion of said cladding member.

11. The device of claim 10 which said first fastener comprises a clevis pin.

12. The device of claim 11 in which said second fastener comprises a clevis pin.

13. The device of claim 10 in which said support is dimensional and that a duplicate of said support serves as a stiffener located beneath said cladding member.

14. The device of claim 10 in which said support is dimensional such that a duplicate of said support serves as a stiffener located between said cladding member and a portion of said support.

15. The device of claim 10 in which said device further comprises third surface capable of holding a reveal strip between the cladding member and said anchor.

16. The device of claim 15 in which said second and third surfaces are spaced from one another on said support and are oriented in different directions from one another.

17. The device of claim 10 in which said first surface is formed as a portion of a protrusion and includes a pocket for holding said reveal strip.

18. The device of claim 17 in which said protrusion is constructed to position adjacent said cladding member and includes a third fastener, said protrusion further comprising a wall formed to receive the penetration of said third fastener.

* * * * *